US011353816B2

(12) United States Patent
Yano et al.

(10) Patent No.: US 11,353,816 B2
(45) Date of Patent: Jun. 7, 2022

(54) DECURLING DEVICE AND IMAGE FORMING APPARATUS INCLUDING THE SAME

(71) Applicant: FUJIFILM Business Innovation Corp., Tokyo (JP)

(72) Inventors: Keita Yano, Kanagawa (JP); Yoshinori Koike, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 45 days.

(21) Appl. No.: 16/856,012

(22) Filed: Apr. 22, 2020

(65) Prior Publication Data

US 2021/0124299 A1 Apr. 29, 2021

(30) Foreign Application Priority Data

Oct. 25, 2019 (JP) ..... JP2019-194251

(51) Int. Cl.
*G03G 15/00* (2006.01)
*G03G 15/20* (2006.01)

(52) U.S. Cl.
CPC ..... *G03G 15/6576* (2013.01); *G03G 15/2028* (2013.01); *G03G 2215/00662* (2013.01); *G03G 2215/00704* (2013.01)

(58) Field of Classification Search
CPC ..... G03G 15/6576; G03G 2215/00662; G03G 2215/00704; G03G 15/2028; G03G 15/6573; B65H 2301/5121; B65H 2301/51256; B65H 2404/1371; B41J 11/0005
See application file for complete search history.

(56) References Cited

U.S. PATENT DOCUMENTS 6,473,592 B2 * 10/2002 Nishio ..... B65H 29/12 399/406
6,965,750 B2 * 11/2005 Muratani ..... G03G 15/6576 271/188
7,298,981 B2 11/2007 Oohara et al.
7,418,233 B2 * 8/2008 Nishimura ..... G03G 15/2064 399/381
8,602,414 B2 * 12/2013 Osaki ..... G03G 15/2028 271/311
9,772,594 B2 * 9/2017 Hamada ..... G03G 15/6576

FOREIGN PATENT DOCUMENTS

JP 2006023427 1/2006

* cited by examiner

*Primary Examiner* — Justin N Olamit
(74) *Attorney, Agent, or Firm* — JCIPRNET

(57) ABSTRACT

A decurling device is provided on a downstream side with respect to a fixing device in a medium transporting direction and straightens a curl formed in a medium transported to the decurling device. The decurling device includes a bending unit extending across the medium transporting direction and having a guiding surface that guides a leading end of the medium, the leading end coming into contact with the guiding surface, the bending unit bending the medium in a decurling direction by using the guiding surface; an urging unit that urges the bending unit toward the medium; and a single or plural rotating members provided on a part of the guiding surface of the bending unit and rotating by coming into contact with the medium that is in contact with the guiding surface.

11 Claims, 12 Drawing Sheets

DECURLING DEVICE AND IMAGE FORMING APPARATUS INCLUDING THE SAME

CROSS-REFERENCE TO RELATED APPLICATIONS

This application is based on and claims priority under 35 USC 119 from Japanese Patent Application No. 2019-194251 filed Oct. 25, 2019.

BACKGROUND

(i) Technical Field

The present disclosure relates to a decurling device and an image forming apparatus including the same.

(ii) Related Art

A decurling device is disclosed by, for example, Japanese Unexamined Patent Application Publication No. 2006-023427.

Japanese Unexamined Patent Application Publication No. 2006-023427 relates to an image forming apparatus including a first fixing unit having a heater thereinside, a second fixing unit provided face to face with the first fixing unit, a pair of transporting rollers provided on the downstream side with respect to the first and second fixing units in a direction of transport of a recording material, a guide with which the recording material exiting from the pair of transporting rollers is urged toward the first fixing unit from behind one of the transporting rollers, and a unit that urges the guide toward the recording material.

SUMMARY

Aspects of non-limiting embodiments of the present disclosure relate to a decurling device that performs decurling suitably for individual media having different thicknesses without deteriorating medium transportability, and also relate to an image forming apparatus including the same.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a decurling device provided on a downstream side with respect to a fixing device in a medium transporting direction and straightening a curl formed in a medium transported to the decurling device. The decurling device includes a bending unit extending across the medium transporting direction and having a guiding surface that guides a leading end of the medium, the leading end coming into contact with the guiding surface, the bending unit bending the medium in a decurling direction by using the guiding surface; an urging unit that urges the bending unit toward the medium; and a single or a plurality of rotating members provided on a part of the guiding surface of the bending unit and rotating by coming into contact with the medium that is in contact with the guiding surface.

BRIEF DESCRIPTION OF THE DRAWINGS

Exemplary embodiments of the present disclosure will be described in detail based on the following figures, wherein.

DETAILED DESCRIPTION

General Embodiment

Figure 1A:
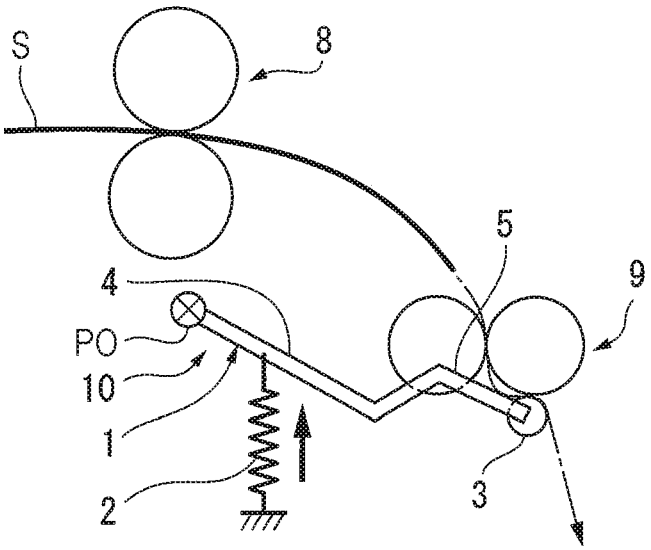
FIG. 1A illustrates a representative example of an image forming apparatus including a decurling device according to a general embodiment of the present disclosure.
Figure 1B:
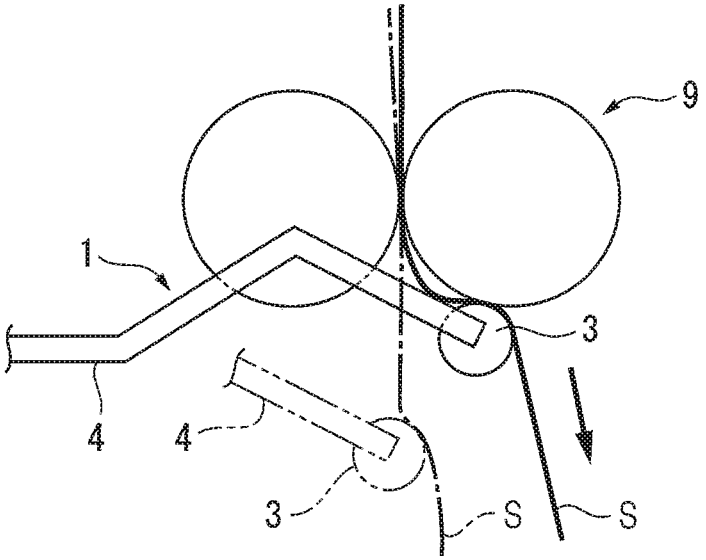
FIG. 1B illustrates relevant elements of the decurling device illustrated in FIG. 1A.
Figure 1C:
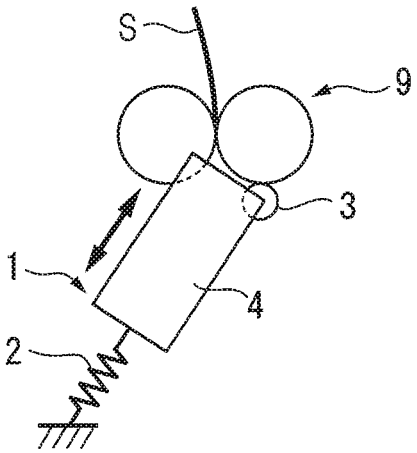
FIG. 1C illustrates another representative example of the decurling device according to the general embodiment.

FIGS. 1A to 1C illustrate an image forming apparatus including a decurling device according to a general embodiment of the present disclosure.

The image forming apparatus illustrated in FIGS. 1A to 1C includes a fixing device 8 that thermally fixes an unfixed image on a medium S, and a decurling device 10 provided on the downstream side with respect to the fixing device 8 in a direction of transport of a medium S (hereinafter referred to as "medium transporting direction"). The decurling device 10 straightens a curl formed in the medium S transported thereto. A transporting unit 9 is provided on the downstream side with respect to the fixing device 8 in the medium transporting direction.

In the general embodiment, the decurling device 10 includes a bending unit 1 extending across the medium transporting direction and having a guiding surface 5 that guides a leading end of the medium S, the leading end coming into contact with the guiding surface 5, the bending unit 1 bending the medium S in a decurling direction by using the guiding surface 5; an urging unit 2 that urges the bending unit 1 toward the medium S; and a single or a plurality of rotating members 3 provided on a part of the guiding surface 5 of the bending unit 1 and rotating by coming into contact with the medium S that is in contact with the guiding surface 5.

While the general embodiment concerns a case where the decurling device 10 is provided on the downstream side in the medium transporting direction with respect to the transporting unit 9 positioned immediately after the fixing device 8, the position of the decurling device 10 is not limited thereto. Needless to say, the decurling device 10 may alternatively be provided nearer to the fixing device 8 than the transporting unit 9.

The bending unit 1 only needs to extend in a direction intersecting the medium transporting direction. Specifically, the bending unit 1 may extend not only in a widthwise direction orthogonal to the medium transporting direction but also in an oblique direction not orthogonal to the medium transporting direction. If the bending unit 1 extends in the medium transporting direction, the leading end of the medium S comes into contact with only one contact point. Such a configuration may lead to insufficient decurling of the leading end of the medium S.

As long as the bending unit 1 has the guiding surface 5 that guides the leading end of the medium S coming into contact therewith, the bending unit 1 may employ any operating method such as a swinging method using a guiding member 4 swingable on a swing fulcrum PO, or a linear-motion method using a guiding member 4 linearly movable back and forth, except a method using a pair of an elastic roller and a rigid roller that are pressed against each other to form a contact site depressed in the decurling direction. The shape of the guiding surface 5 is not limited to a flat shape and may be a curved shape.

The urging force to be exerted by the urging unit 2 may be set according to need, as long as a thin medium having a small thickness and that highly requires decurling is decurled along the guiding surface 5 such that the thin medium, which is soft, does not cause the bending unit 1 to retract against the urging force exerted by the urging unit 2. In contrast, a thick medium having a large thickness and that does not highly require decurling does not need to be decurled, as long as the thick medium, which is hard, causes the bending unit 1 to retract against the urging force exerted by the urging unit 2.

Whether the medium S is a thick medium or a thin medium may be defined with reference to any threshold such as a basis weight of 120 gsm. The urging force of the urging unit 2 needs to be determined considering the rigidity of the thick medium thus defined.

The rotating member 3 may have any sectional shape such as a cylindrical shape, a round columnar shape, an inverted-V shape, or the like, as long as the rotating member 3 is rotatable by coming into contact with and thus following the movement of the medium S that is transported. However, considering the quality of decurling of the medium S, a contact part of the rotating member 3 that comes into contact with the medium S may be shaped as flat as possible.

Now, representative and other examples of the decurling device 10 according to the general embodiment will be described.

Referring to FIGS. 1A and 1B, in a representative example of the bending unit 1 according to the general embodiment, the bending unit 1 is a guiding member 4 movable toward and retractable from a path of transport of a medium S (hereinafter referred to as "medium transport path") along a curved locus and having a guiding surface 5 that guides a leading end of a medium S coming into contact therewith.

In this representative example, the bending unit 1 may be a plate-shaped guiding member 4 positioned in a predetermined orientation with a part thereof serving as a swing fulcrum PO, the guiding member 4 having a guiding surface 5 that guides the leading end of the medium S coming into contact therewith. The bending unit 1 according to this example is swingable. In such a case, the guiding member 4 only needs to be supported in such a manner as to be swingable on the swing fulcrum PO.

In another representative example of the bending unit 1, referring to FIG. 1C, the bending unit 1 is a guiding member 4 movable toward and retractable from the medium transport path along a linear locus and having a guiding surface 5 that guides a leading end of a medium S coming into contact therewith.

As a criterion for setting the urging force of the urging unit 2, if the medium S is a thick medium having a thickness greater than or equal to a predetermined threshold, the guiding surface 5 of the bending unit 1 may be retracted against the urging force of the urging unit 2 in such a manner as to follow the movement of the medium S.

As another criterion for setting the urging force of the urging unit 2, if the medium S is a thin medium having a thickness smaller than the predetermined threshold, the guiding surface 5 of the bending unit 1 may be retained at a predetermined position.

As an example of the rotating member 3, a contact part of the rotating member 3 that comes into contact with the medium S may have a flat or curved shape in a widthwise direction intersecting the medium transporting direction. This example focuses on the shape of the contact part coming into contact with the medium S.

From another viewpoint regarding the rotating member 3, at least a part of the rotating member 3 may be shaped with a peripheral surface forming a circular section that is constant in the widthwise direction intersecting the medium transporting direction. This example focuses on the sectional shape of the rotating member 3, such as a cylindrical shape, a round columnar shape, or a combination of a plurality of separate cylinders or round columns.

As an example utilizing the transporting unit 9, the decurling device 10 may further include the transporting unit 9 provided between the fixing device 8 and the bending unit 1 and that transports the medium S while nipping the medium S. Furthermore, the bending unit 1 may be provided on the downstream side with respect to the transporting unit 9 in the medium transporting direction. Furthermore, the rotating member 3 may be positioned in contact with the transporting unit 9.

As another example utilizing the transporting unit 9, a contact point between the rotating member 3 and the transporting unit 9 may be defined on the downstream side in the medium transporting direction with respect to a contact point between the leading end of the medium S exited from the transporting unit 9 and the guiding surface 5 of the bending unit 1. In this example, the leading end of the medium S exited from the transporting unit 9 first comes into contact with the guiding surface 5 and then passes through a contact site between the rotating member 3 and the transporting unit 9.

From another viewpoint regarding the use of the transporting unit 9, the contact point between the rotating member 3 and the transporting unit 9 may be displaced from a virtual line along which the transporting unit 9 transports the medium S.

As yet another example utilizing the transporting unit 9, the decurling device 10 may further include the transporting unit 9 provided between the fixing device 8 and the bending unit 1 and that transports the medium S while nipping the medium S. Furthermore, the transporting unit 9 may include a plurality of separate transporting members (not illustrated in FIGS. 1A to 1C) arranged at intervals in a crosswise direction of the medium S (hereinafter referred to as "medium crosswise direction") and each having a nipping site where the medium S is nipped. Furthermore, the bending unit 1 may be provided on the downstream side with respect to the transporting unit 9 in the medium transporting direction. Furthermore, the guiding member 4 may be positioned avoiding the separate transporting members.

As yet another example, the decurling device 10 may further include a fixed guiding unit (not illustrated in FIGS. 1A to 1C) fixedly provided along the medium transport path and that guides the medium S. Furthermore, the bending unit 1 may be positioned adjacent to and on the upstream side with respect to the fixed guiding unit in the medium transporting direction. Furthermore, the fixed guiding unit may have a fixed guiding surface (not illustrated in FIGS. 1A to 1C) provided on a virtual line along which the medium S having passed the bending unit 1 advances, the fixed guiding surface guiding the medium S coming into contact therewith.

The present disclosure will be described in more detail on the basis of exemplary embodiments illustrated in the attached drawings.

First Exemplary Embodiment

Figure 2:
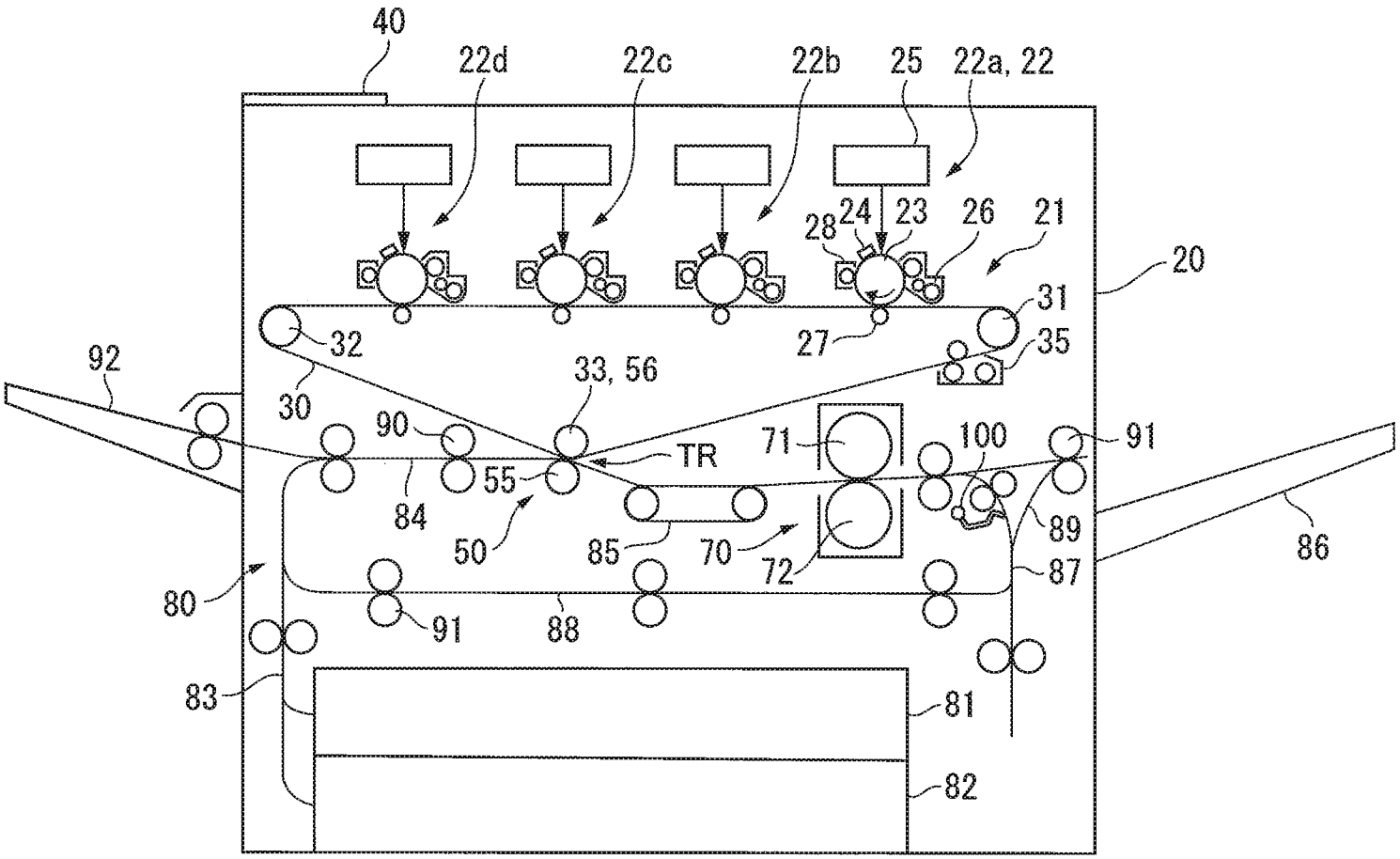
FIG. 2 illustrates an overall configuration of an image forming apparatus according to a first exemplary embodiment.

FIG. 2 illustrates an overall configuration of an image forming apparatus according to a first exemplary embodiment.

Overall Configuration of Image Forming Apparatus

The image forming apparatus illustrated in FIG. 2 basically includes, in an apparatus housing 20, an imaging engine 21 that forms an image by using, for example, a plurality of color components; a medium transporting system 80 provided below the imaging engine 21 and that transports a medium to the imaging engine 21; and a fixing device 70 that fixes the image formed by the imaging engine 21 to the medium.

The imaging engine 21 according to the first exemplary embodiment includes image forming units 22 (specifically, 22*a* to 22*d*) that form respective images in general colors corresponding to the respective color components (in the first exemplary embodiment, yellow (Y), magenta (M), cyan (C), and black (K)), a belt-type intermediate transfer body 30 to which the color-component images formed by the respective image forming units 22 are sequentially transferred (first-transferred) and held, and a second transfer device (a collective transfer device) 50 with which the color-component images on the intermediate transfer body 30 are second-transferred (collectively transferred) to a medium (a sheet or a film). As illustrated in FIG. 2, the image forming apparatus further includes an operation panel 40 on which the image forming apparatus is operated.

Image Forming Unit

The image forming units 22 (22*a* to 22*d*) according to the first exemplary embodiment each include a drum-type photoconductor 23. The photoconductor 23 is provided therearound with a charging device 24 such as a corotron or a transfer roller that charges the photoconductor 23, an exposure device 25 such as a laser scanning device that forms an electrostatic latent image on the charged photoconductor 23, a developing device 26 that develops the electrostatic latent image on the photoconductor 23 into a toner image with toner containing a corresponding one of the color components of Y, M, C, and K, a first transfer device 27 such as a transfer roller that transfers the toner image from the photoconductor 23 to the intermediate transfer body 30, and a photoconductor cleaning device 28 that removes residual toner from the photoconductor 23.

The intermediate transfer body 30 is stretched around a plurality (three in the first exemplary embodiment) of stretching rollers 31 to 33. The stretching roller 31, for example, is used as a driving roller that is driven by a driving motor (not illustrated). The intermediate transfer body 30 is rotated by the driving roller. The image forming apparatus further includes an intermediate-transfer-body-cleaning device 35 provided between the stretching rollers 31 and 33 and that removes residual toner from part of the intermediate transfer body 30 that has undergone the second transfer.

Second Transfer Device (Collective Transfer Device)

The second transfer device (collective transfer device) 50 includes, for example, a transfer roller 55 pressed against the intermediate transfer body 30 at a position across from the stretching roller 33. The stretching roller 33 serves as a counter roller 56 forming a counter electrode for the transfer roller 55. In the first exemplary embodiment, the transfer roller 55 includes a metal shaft provided therearound with an elastic layer such as urethane foam rubber or ethylene-propylene terpolymer (EPDM) containing carbon black or the like. A transfer voltage generated by a transfer power supply (not illustrated) is applied to the counter roller 56 (also serving as the stretching roller 33 in the first exemplary embodiment) through a conductive power feeding roller (not illustrated). Meanwhile, the transfer roller 55 is grounded. Thus, a predetermined transfer electric field is generated between the transfer roller 55 and the counter roller 56. Furthermore, a nip site of the intermediate transfer body 30 that is held between the transfer roller 55 and the counter roller 56 serves as a second transfer site (a collective transfer site) TR. While the second transfer device 50 according to the first exemplary embodiment includes the transfer roller 55, the second transfer device 50 is not limited thereto. Needless to say, the second transfer device 50 may be a transfer belt module or the like including the transfer roller 55 as one of stretching rollers around which a transfer belt is stretched.

Fixing Device

The fixing device 70 includes a thermal fixing roller 71 to be in contact with an image carrying surface of the medium and being rotatable when driven, and a pressure fixing roller 72 pressed against the thermal fixing roller 71 and that rotates by following the thermal fixing roller 71. The fixing device 70 allows the image on the medium to pass through a fixing site defined between the two fixing rollers 71 and 72, thereby fixing the image by applying heat and pressure thereto.

The thermal fixing roller 71 includes, for example, a heater inside a roller body thereof or is provided with an external heater to be brought into contact with the outer peripheral surface of the roller body, so that the roller body is heated. Needless to say, the pressure fixing roller 72 may also be provided with a heater, according to need. While the first exemplary embodiment concerns a case where the fixing device 70 includes a pair of rollers, the fixing device 70 is not limited thereto. The thermal fixing roller 71 may be replaced with, for example, a thermal fixing belt employing an induction heating method, or the like.

Medium Transporting System

The medium transporting system 80 includes a plurality (two in the first exemplary embodiment) of medium supplying containers 81 and 82. The medium transporting system 80 transports a medium from either of the medium supplying containers 81 and 82 to the second transfer site TR through a vertical transport path 83 extending substantially vertically and a horizontal transport path 84 extending substantially horizontally. Subsequently, the medium receives an image transferred thereto, advances along a transporting belt 85 to a fixing part in the fixing device 70, and is discharged to an output medium receiver 86 provided on a side face of the apparatus housing 20.

The medium transporting system 80 further includes a branched transport path 87 branching off downward from the horizontal transport path 84 at a position on the downstream side with respect to the fixing device 70 in the medium transporting direction. The medium is turned over in the branched transport path 87. The medium turned over in the branched transport path 87 is transported into a return transport path 88, is fed into the vertical transport path 83 again, and advances through the horizontal transport path 84 to the second transfer site TR, where another image is transferred to the back side of the medium. Subsequently, the medium passes through the fixing device 70 and is discharged to the output medium receiver 86. The branched transport path 87 includes a branch return path 89 branching off from a halfway position of the branched transport path 87 and through which the medium to be turned over is transported toward the output medium receiver 86.

The medium transporting system 80 further includes a registration roller 90 that sets the medium in position and then supplies the medium to the second transfer site TR, and an appropriate number of transporting rollers 91 provided in the transport paths 83, 84, 87, and 88. Furthermore, the apparatus housing 20 is provided on a side face thereof opposite the output medium receiver 86 with a manual medium feeding device 92 that allows manual feeding of a medium into the horizontal transport path 84.

Necessity of Decurling

In a typical duplex printing mode, a medium having undergone the fixing process in the fixing device 70 and thus having a first image printed on a first side thereof is turned over in the branched transport path 87, advances through the return transport path 88, returns into the vertical transport path 83 and the horizontal transport path 84, and reaches the second transfer site TR, where a second image is second-transferred to a second side of the medium from the intermediate transfer body 30.

In the above process, if, for example, the second side of the medium that carries the second image is heated higher than the first side of the medium by the thermal fixing roller 71 of the fixing device 70, the second side of the medium tends to undergo thermal expansion, causing an end of the medium to curl downward (so-called downcurling). If the medium in such a state is turned over and is transported toward the second transfer site TR, the medium approaches the second transfer site TR with the leading end thereof curling upward (so-called upcurling). However, the upcurled leading end of the medium has difficulty in entering the second transfer site TR. Therefore, the operation of image transfer to the second side of the medium tends to become instable.

Figure 3:
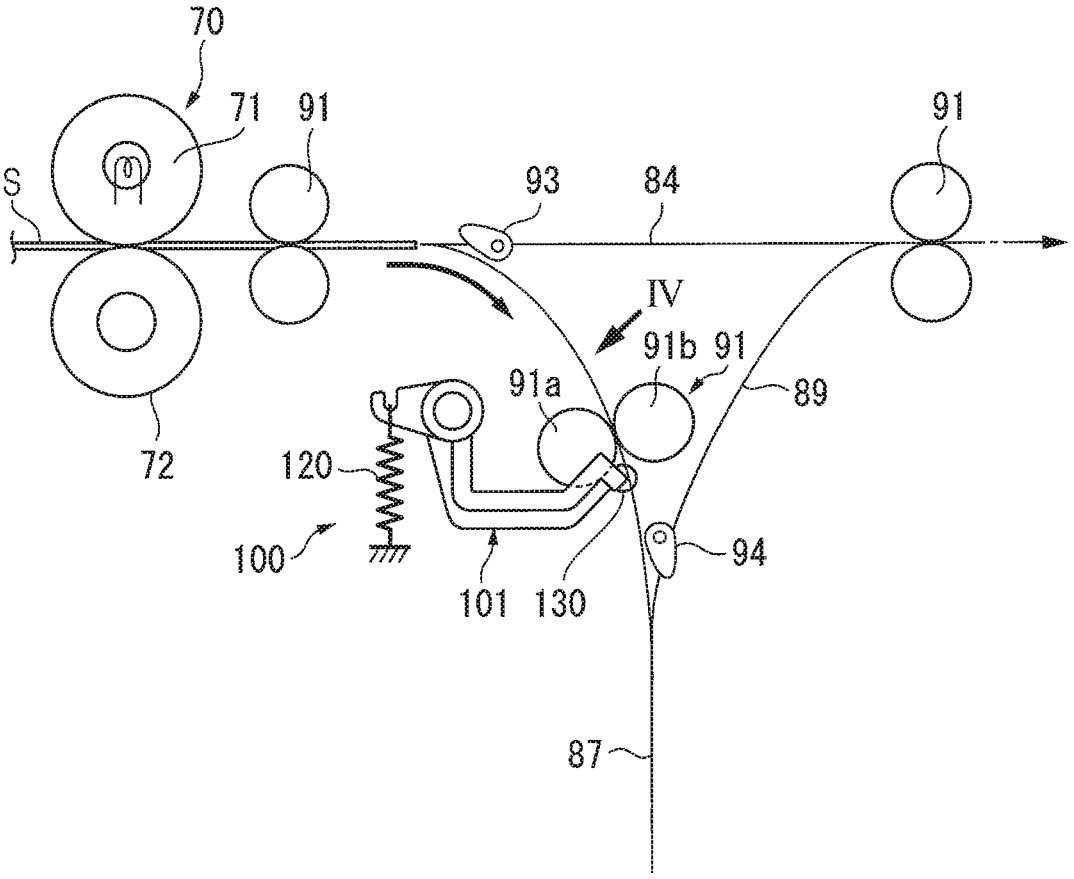
FIG. 3 illustrates details of a decurling device and relevant elements included in the image forming apparatus according to the first exemplary embodiment.

Accordingly, as illustrated in FIG. 3, the first exemplary embodiment employs a first switching gate 93 provided at a branching point between the horizontal transport path 84 and the branched transport path 87, a second switching gate 94 provided at a branching point between the branched transport path 87 and the branch return path 89, a transporting roller 91 provided at a position of the branched transport path 87 between the first switching gate 93 and the second switching gate 94, and a decurling device 100 provided on the downstream side with respect to a nip site NP (see FIG. 5) of the transporting roller 91 in the medium transporting direction.

Basic Configuration of Decurling Device

As illustrated in FIGS. 3 to 6A, the decurling device 100 according to the first exemplary embodiment includes a guide plate (corresponding to the guiding member) 101 as the bending unit. The guide plate 101 extends across the medium transporting direction. A leading end of a medium S comes into contact with the guide plate 101, whereby the medium S is bent in the decurling direction.

In the first exemplary embodiment, the guide plate 101 is swingable on a support shaft 110 serving as a swing fulcrum PO. The support shaft 110 is a single elongated member made of synthetic resin such as acrylonitrile butadiene styrene (ABS) resin, polycarbonate (PC) resin, or the like and extends in a direction intersecting the medium transporting direction. The guide plate 101 includes arm portions 102 each extending in the radial direction from the support shaft 110 while forming a substantially U sectional shape. The guide plate 101 further includes contact portions 103 projecting from distal ends of the respective arm portions 102 into the medium transport path. The leading end of the medium S comes into contact with the contact portions 103. Note that the support shaft 110 according to the first exemplary embodiment includes large-diameter portions 111 and small-diameter portions 112 that are alternately positioned. The arm portions 102 are provided on the respective large-diameter portions 111.

The contact portions 103 each have a substantially flat guiding surface 104. The guiding surface 104 forms a slope in the medium transporting direction such that the medium S passing through a contact site CN defined between the guiding surface 104 and the transporting roller 91 is bent in the decurling direction (in the first exemplary embodiment, a direction in which the downcurl is straightened).

In the first exemplary embodiment, the support shaft 110 supporting the guide plate 101 is provided with a pair of projecting members 107 near two respective long-side ends thereof. The projecting members 107 project in a direction opposite to the direction in which the arm portions 102 project. The projecting members 107 each have a catching hook 108 at a distal end thereof. An urging spring 120 is stretched between the catching hook 108 and a predetermined fixed part, so that the guiding surfaces 104 of the guide plate 101 are each set to a predetermined initial position with an urging force exerted by the urging spring 120.

The urging force of the urging spring 120 may be set according to need. Specifically, the urging force may be set such that when the leading end of a thick medium S having, for example, a basis weight of 120 gsm or greater comes into contact with the guiding surfaces 104 of the guide plate 101, the thick medium, which is rigid, causes the guide plate 101 to rotate on the swing fulcrum PO in a retracting direction against the urging force of the urging spring 120.

(Positional Relationship Between Guide Plate and Transporting Roller)

In the first exemplary embodiment, as illustrated in FIGS. 4 to 6A, the transporting roller 91 provided close to the decurling device 100 includes a driving roller 91*a* and a follower roller 91*b* that rotates by following the driving roller 91*a*. In the first exemplary embodiment, the driving roller 91*a* includes a plurality of separate roller members 912 arranged at intervals on a rotating shaft 911 extending in an axial direction. The follower roller 91*b* includes a continuous roller member 916 provided continuously over a rotating shaft 915 extending in the axial direction.

Figure 4:
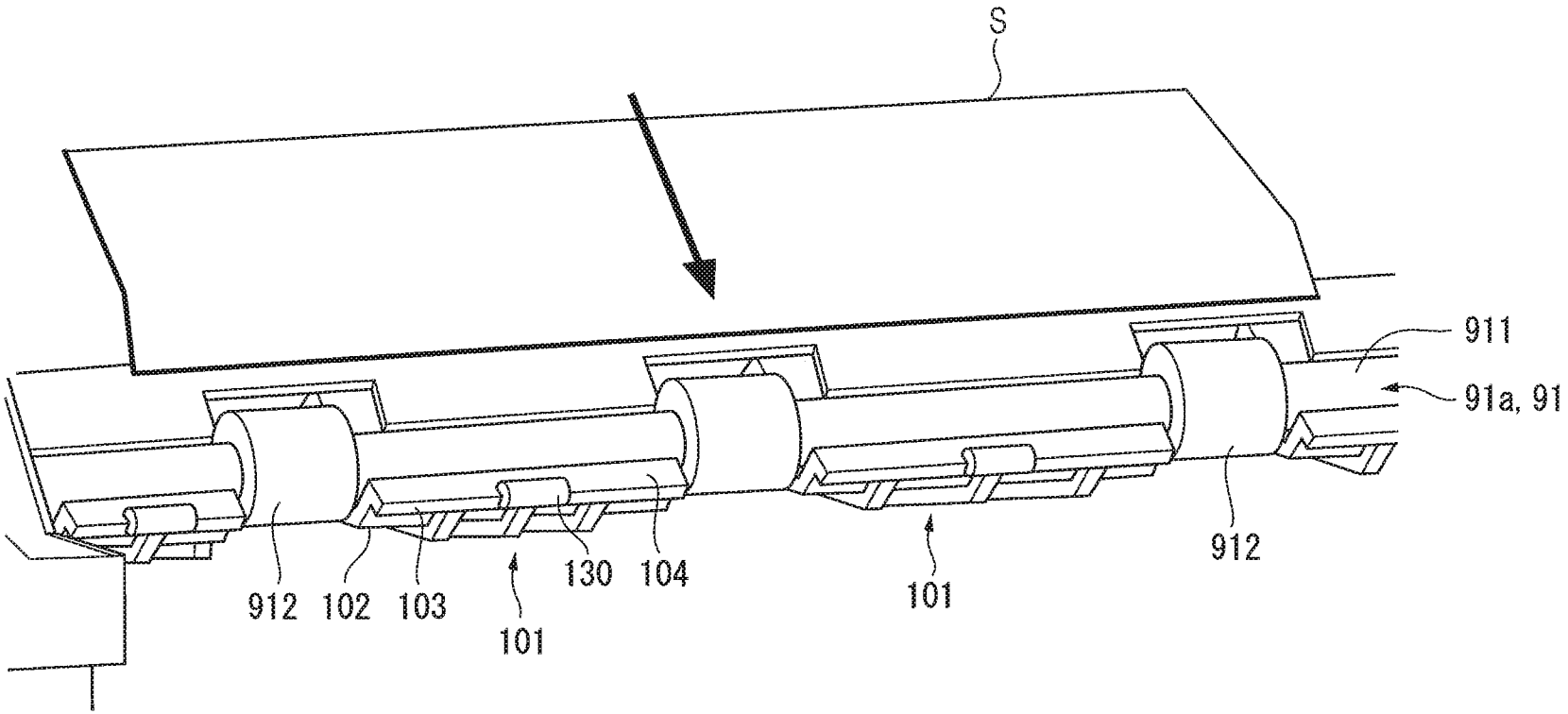
FIG. 4 illustrates the decurling device seen in a direction of arrow IV illustrated in FIG. 3.
Figure 6A:
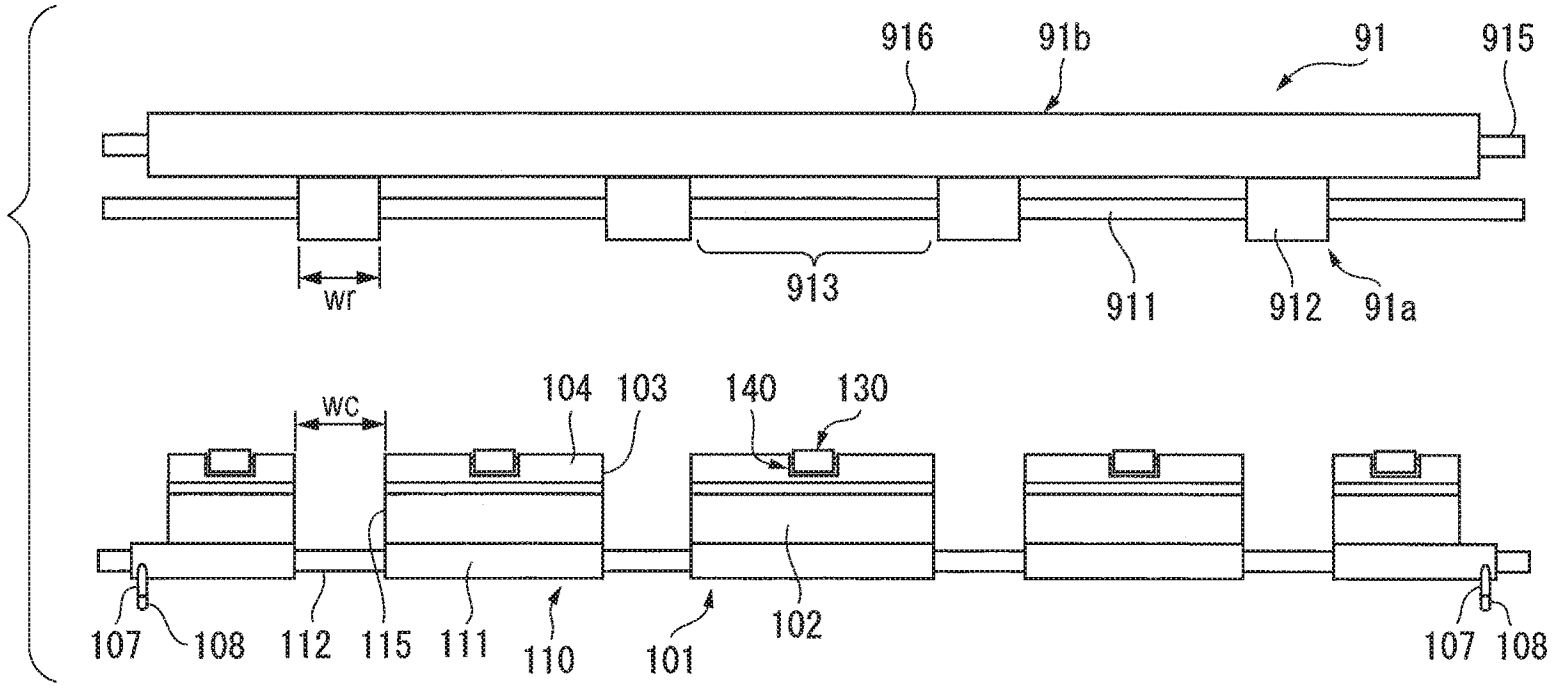
FIG. 6A illustrates the decurling device and a transporting roller originally overlapping each other seen in a direction of arrow VIA illustrated in FIG. 5 with the decurling device being retracted substantially horizontally.
Figure 6B:
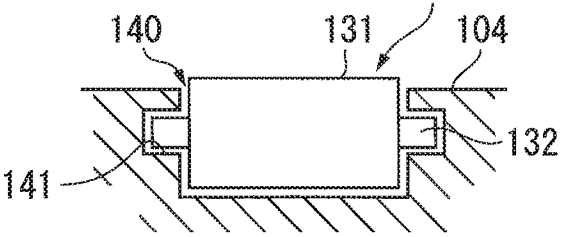
FIG. 6B illustrates an exemplary structure of an assist roller attached to a guide plate.

In the first exemplary embodiment, the guide plate 101 does not interfere with the driving roller 91*a*. Specifically, as illustrated in FIGS. 4 and 6A particularly, the guide plate 101 is configured such that the arm portions 102, inclusive of the contact portions 103, arranged at intervals project at positions corresponding to respective spaces 913 each provided between adjacent ones of the separate roller members 912 of the driving roller 91*a* included in the transporting roller 91. The guide plate 101 has cuts 115 each provided between adjacent ones of the arm portions 102 that are separate from one another. The cuts 115 each have a width we greater than a width wr of each of the separate roller members 912. Therefore, in the first exemplary embodiment, the guide plate 101 of the decurling device 100 is positioned close to the transporting roller 91.

Assist Roller

In the first exemplary embodiment, the guide plate 101 includes assist rollers 130 rotatably provided at a distal end thereof that is farther from the support shaft 110, specifically on a side of the respective contact portions 103 that is nearer to the medium transport path. The assist rollers 130 each correspond to the rotating member.

Referring to FIGS. 4 to 7A, the assist rollers 130 according to the first exemplary embodiment each include, for example, a round-columnar roller body 131, and shaft portions 132 projecting from two respective side faces of the roller body 131. On the other hand, the contact portions 103 of the guide plate 101 each have a receiving recess 140 provided substantially at the center of an end of the guiding surface 104 that is on the leading side in the medium transporting direction. The receiving recess 140 receives the assist roller 130 fitted therein. The receiving recess 140 has a substantially rectangular-parallelepiped shape that is open on two sides, specifically a side corresponding to the guiding surface 104 and a side corresponding to a distal end face of the contact portion 103. Two sides of the inner wall of the receiving recess 140 in the medium crosswise direction (corresponding to the widthwise direction in the first exemplary embodiment) have respective bearing portions 141 that hold the respective shaft portions 132 of the assist roller 130 while allowing the shaft portions 132 to rotate. The bearing portions 141 are each a hole having a circular section. In the first exemplary embodiment, the shaft portions 132 of the assist roller 130 are made of an elastic material and are elastically deformable. Therefore, when the assist roller 130 is attached to the receiving recess 140, the shaft portions 132 of the assist roller 130 are elastically deformed to be fitted into the respective bearing portions 141 of the receiving recess 140.

Attention to be Paid in Positioning Assist Roller

In the first exemplary embodiment, the peripheral surface of the assist roller 130 projects slightly upward from the guiding surface 104 of the contact portion 103 and also projects slightly from the distal end face of the contact portion 103 toward the leading side in the medium transporting direction. The medium S transported along the guiding surface 104 comes into contact with the assist roller 130 and causes the assist roller 130 to rotate while passing over the guiding surface 104 and the assist roller 130.

In the first exemplary embodiment, the guide plate 101 is urged by the urging spring 120, and the initial position of the guiding surface 104 of the guide plate 101 is set in proximity to the peripheral surface of the follower roller 91*b* included in the transport roller 91. Furthermore, the assist roller 130 is positioned in contact with the peripheral surface of the follower roller 91*b* of the transporting roller 91 positioned adjacent to the guide plate 101.

In the first exemplary embodiment, the contact point between the assist roller 130 and the follower roller 91*b* of the transporting roller 91 is defined on the downstream side in the medium transporting direction with respect to the contact point between the leading end of the medium S exited from the nip site NP of the transporting roller 91 and the guiding surface 104 of the guide plate 101.

Furthermore, the contact point between the assist roller 130 and the follower roller 91*b* of the transporting roller 91 is displaced from a virtual line along which the transporting roller 91 transports the medium S.

Shape of Assist Roller

Figure 7A:
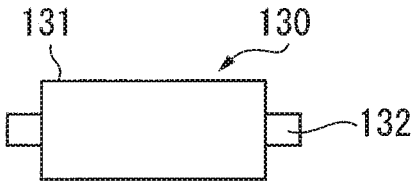
FIGS. 7A to 7E illustrate exemplary shapes of the assist roller.
Figure 7B:
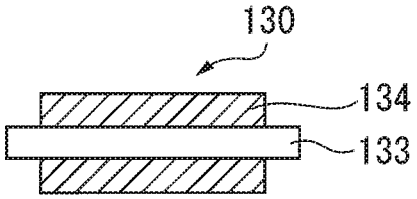

The shape of the assist roller 130 is not limited to the example illustrated in FIG. 7A (the round columnar roller body 131 and the shaft portions 132). For example, as illustrated in FIG. 7B, the assist roller 130 may include a rotating shaft 133 and a cylindrical roller body 134 fitted on the rotating shaft 133.

Figure 7C:
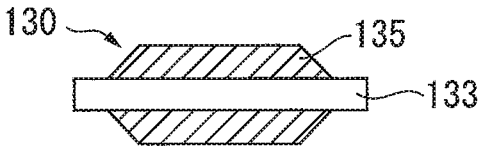
Figure 7D:
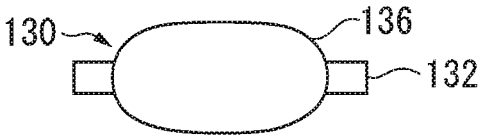
Figure 7E:
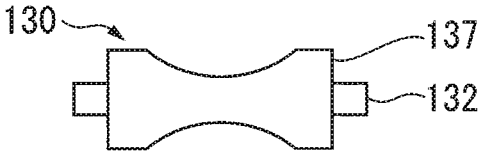

Alternatively, as illustrated in FIG. 7C, the assist roller 130 may include a rotating shaft 133 and a modified cylindrical roller body 135 fitted on the rotating shaft 133. The modified cylindrical roller body 135 has a diameter that is gradually reduced from positions near two respective ends thereof toward the two ends. Alternatively, as illustrated in FIG. 7D, the assist roller 130 may include a roller body 136 having an elliptical sectional shape and shaft portions 132 provided on two respective sides of the roller body 136. Alternatively, as illustrated in FIG. 7E, the assist roller 130 may include a round columnar roller body 137 having a depression in a middle part thereof, and shaft portions 132 provided on two respective sides of the roller body 132.

That is, the assist roller 130 may have any shape. However, from a viewpoint of reducing the sliding resistance, a contact part of the assist roller 130 that comes into contact with the medium S may be flat or curved in the widthwise direction intersecting the medium transporting direction. Alternatively, at least a part of the assist roller 130 may be shaped with a peripheral surface forming a circular section that is constant in the widthwise direction intersecting the medium transporting direction.

Fixed Guiding Chute

Figure 5:
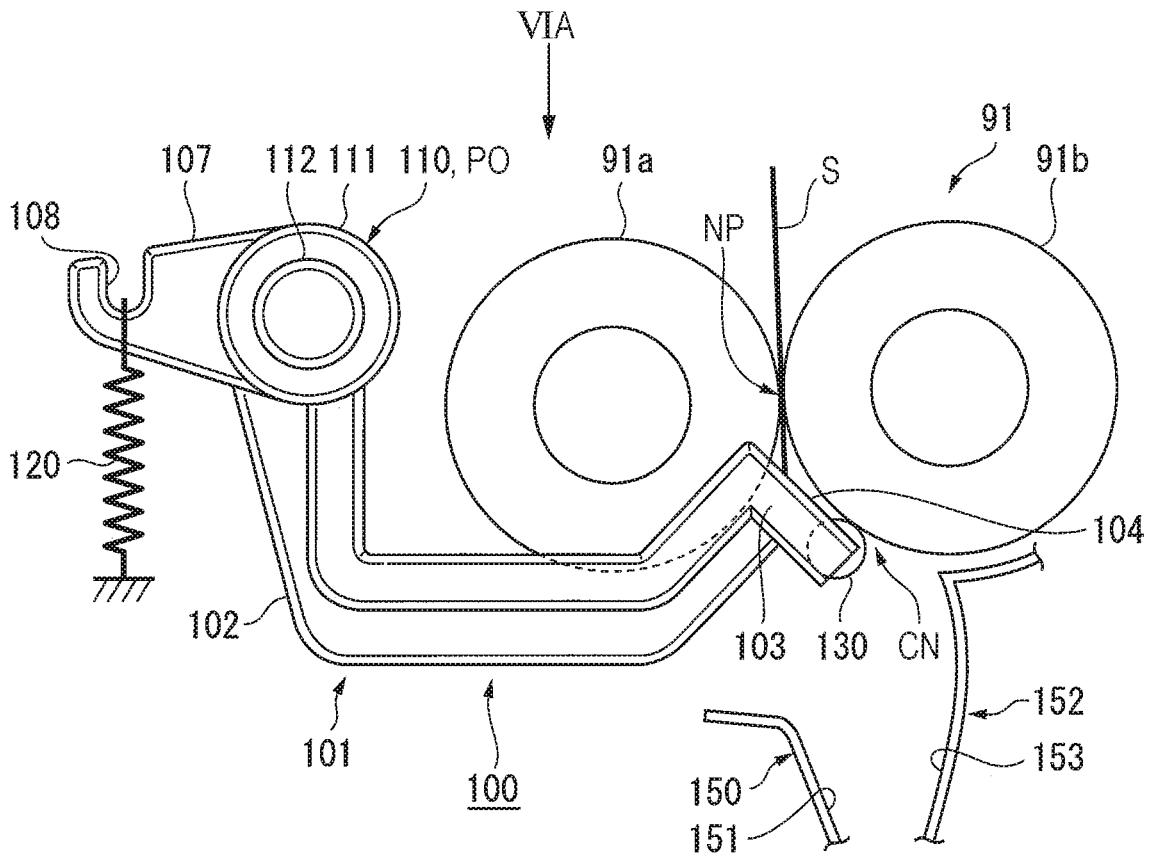
FIG. 5 is an enlargement of the decurling device illustrated in FIG. 3.

As illustrated in FIG. 5, the decurling device 100 according to the first exemplary embodiment includes fixed guiding chutes 150 and 152 fixedly provided on the downstream side with respect to the guide plate 101 in the medium transporting direction. The fixed guiding chutes 150 and 152 guide the medium S having passed the guide plate 101.

In the first exemplary embodiment, the fixed guiding chute 150 has a fixed guiding surface 151. For example, in a case where the medium S is a thick-type medium (thick medium) having a predetermined thickness or greater, the guide plate 101 of the decurling device 100 may be retracted against the urging force of the urging spring 120 as to be described below. Even in such a situation, the medium S having passed the guide plate 101 comes into contact with and is guided along the fixed guiding surface 151.

The fixed guiding chute 152 is positioned on an extension of the guiding surface 104 of the guide plate 101 and has a fixed guiding surface 153. For example, in a case where the medium S is a thin-type medium (a thin medium) having a thickness smaller than the predetermined thickness, the medium S passes through the contact site CN defined between the assist roller 130 and the transporting roller 91 (specifically the follower roller 91*b*). Even if the medium S is transported in a tangential direction with respect to the contact site CN, the medium S comes into contact with the fixed guiding surface 153 and is thus guided downward.

Operation of Image Forming Apparatus

An operation of the image forming apparatus according to the first exemplary embodiment will now be described.

According to the first exemplary embodiment, for example, when a duplex printing mode is designated on the operation panel 40 (see FIG. 2), the imaging engine 21 forms a first image. The first image is transferred at the second transfer site TR to a first surface (one side) of a medium S supplied from the medium supplying container 81 or 82. Subsequently, the medium is transported through the fixing device 70, the branched transport path 87, and the return transport path 88 and reaches the second transfer site TR, where a second image formed by the imaging engine 21 is transferred to a second surface (the other side) of the medium S. Then, the medium S is transported through the fixing device 70 again and is discharged to the output medium receiver 86.

Decurling Performed by Decurling Device

In the above image forming process, when the medium S having undergone printing on the one side advances through the branched transport path 87, decurling is performed by the decurling device 100.

(Decurling of Thin Medium)

Figure 8:
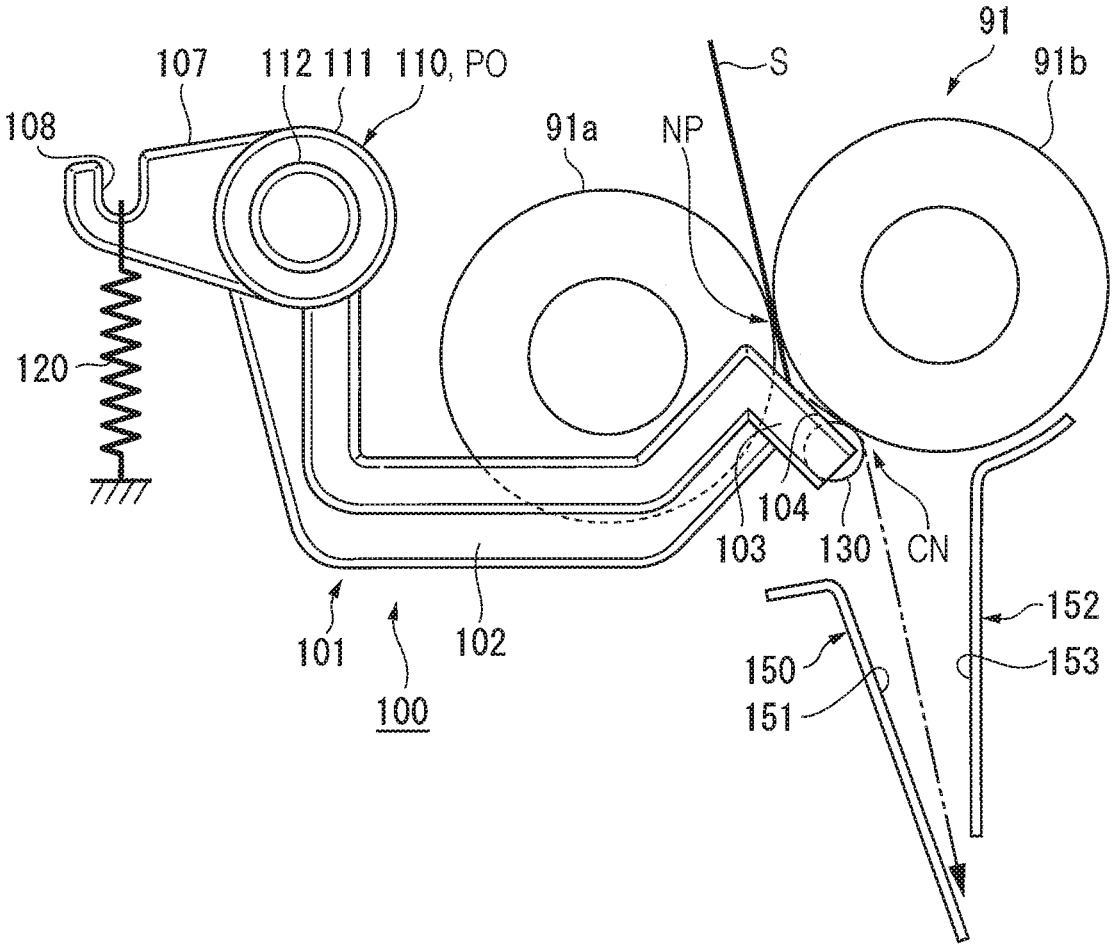
FIG. 8 schematically illustrates a decurling operation performed by the decurling device in a case of a thin medium.

In the first exemplary embodiment, if the medium S is a thin-type medium (a thin medium) having a thickness smaller than a predetermined thickness, the decurling device 100 operates as follows. Referring to FIG. 8, the leading end of the medium S exited from the fixing device 70 comes into contact with the guiding surface 104 of the guide plate 101. However, the medium S is too soft to generate a pressing force resisting the urging force exerted by the urging spring 120. Therefore, the medium S moves along the guiding surface 104 of the guide plate 101 and passes through the contact site CN defined between the assist roller 130 and the transporting roller 91 (specifically the follower roller 91*b*), specifically, at a position of the guiding surface 104 that is on the leading side in the medium transporting direction. Thus, the medium S advances over the guiding surface 104.

In this process, the medium S that has come into contact with the guiding surface 104 while being nipped at the nip site NP of the transporting roller 91 moves along the guiding surface 104, is nipped at the contact site CN defined between the assist roller 130 and the transporting roller 91 (specifically the follower roller 91*b*), and is then transported toward the downstream side in the medium transporting direction. That is, the medium S moves along the guiding surface 104 while being nipped at two parts thereof that are on the leading side and the trailing side with respect to the guiding surface 104 in the traveling direction. When the medium S passes through the contact site CN between the assist roller 130 and the follower roller 91*b* of the transporting roller 91, the medium S moves while causing the rollers 130 and 91*b* to rotate.

Furthermore, even if the medium S exited from the contact site CN between the assist roller 130 and the transporting roller 91 temporarily advances along an extension of the contact site CN, the medium S comes into contact with the fixed guiding surface 153 of the fixed guiding chute 152 and is thus transported downward.

(Decurling of Thick Medium)

Figure 9:
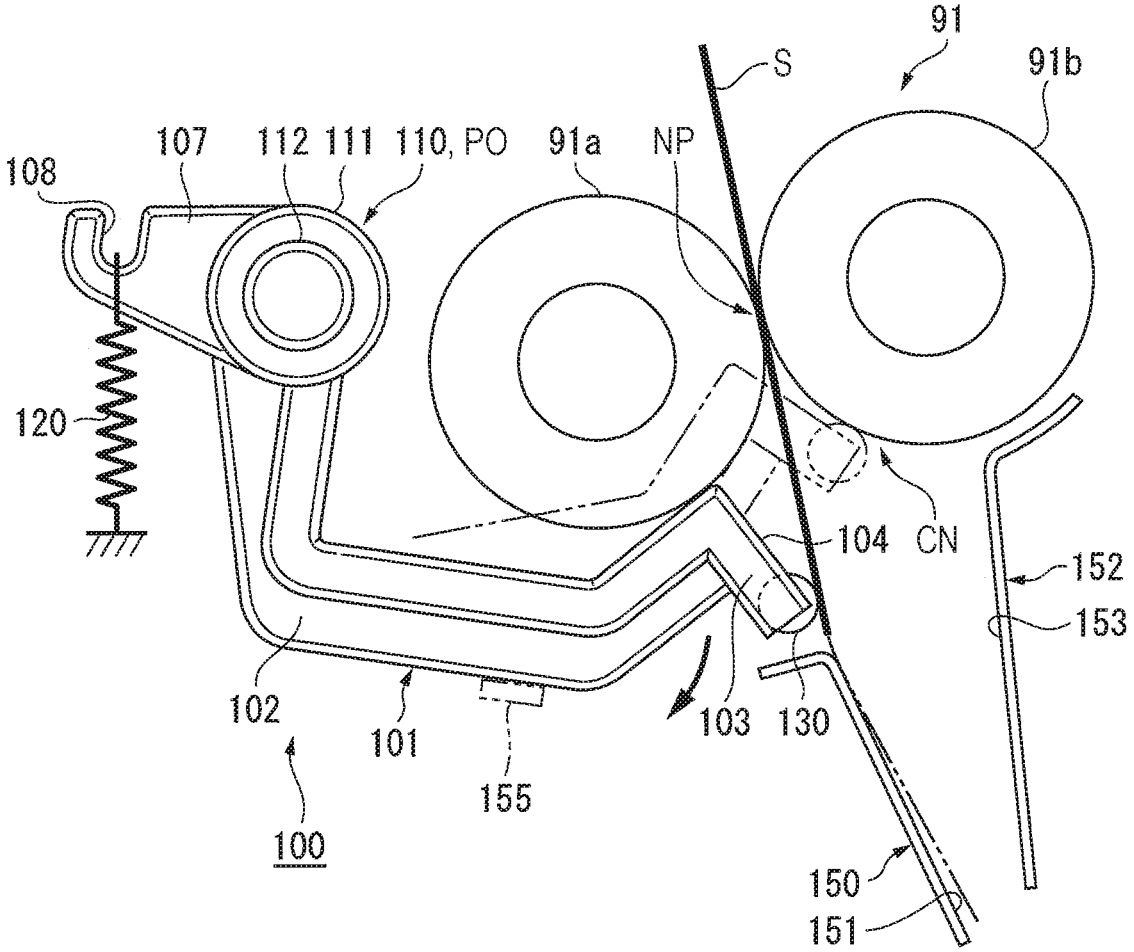
FIG. 9 schematically illustrates how the decurling device behaves in a case of a thick medium.

In contrast, for example, if the medium S is a thick-type medium (a thick medium) having a predetermined thickness or greater, the decurling device 100 operates as follows. Referring to FIG. 9, when the leading end of the medium S exited from the fixing device 70 passes through the nip site NP of the transporting roller 91, the leading end of the medium S comes into contact with the guiding surface 104 of the guide plate 101. In this state, as illustrated by a two-dot chain line in FIG. 9, the guiding surface 104 of the guide plate 101 is pushed by the medium S that is hard enough to resist the urging force exerted by the urging spring 120. Consequently, the leading end of the medium S advances in a direction substantially parallel to the direction in which the transporting roller 91 transports the medium S.

In this process, the leading end of the medium S advances over the assist roller 130 positioned at the distal end of the guiding surface 104. The assist roller 130 is brought into contact with the leading end of the medium S because of the urging force exerted by the urging spring 120. In this state, a certain level of contact pressure is generated. However, the assist roller 130 rotates in such a manner as to follow the movement of the medium S by coming into contact with the medium S.

Therefore, in the first exemplary embodiment, the leading end of the thick medium S is less likely to curl even after passing through the fixing device 70. Although the thick medium S advances while being in contact with the guide plate 101 of the decurling device 100, the medium S passes the decurling device 100 with good transportability and without being decurled by the guide plate 101.

Moreover, the thick medium S pushes the guide plate 101 in the retracting direction against the urging force exerted by the urging spring 120 and is transported over the guiding surface 104 and the assist roller 130 of the guide plate 101. In this process, the medium S continues to be transported substantially in a tangential direction with respect to the nip site NP of the transporting roller 91. In such a state, the direction in which the medium S having passed the guide plate 101 is transported is displaced toward the medium transport path with respect to the entrance of the fixed guiding surface 151 of the fixed guiding chute 150. Hence, there is no chance that the medium S having passed the guide plate 101 may be stopped at the entrance of the fixed guiding chute 150. Therefore, the medium S is transported along the fixed guiding surface 151 of the fixed guiding chute 150.

In the first exemplary embodiment, the thick medium is assumed to have a basis weight ranging from about 120 gsm to about 350 gsm. The greater the basis weight of the medium S, the greater the length by which the guide plate 101 is pushed in the retracting direction. Therefore, the length by which the guide plate 101 is pushed in the retracting direction may be adjusted by setting the urging force of the urging spring 120 to such a level that a thick medium having the maximum basis weight of 350 gsm and having passed the guide plate 101 is not stopped at the entrance of the fixed guiding chute 150.

To limit the length by which the guide plate 101 is pushed in the retracting direction, as illustrated by the two-dot chain line in FIG. 9 for example, a stopper 155 may be added. Needless to say, the stopper 155 may also be employed in second and third exemplary embodiments described below.

Second Exemplary Embodiment

Figure 10:
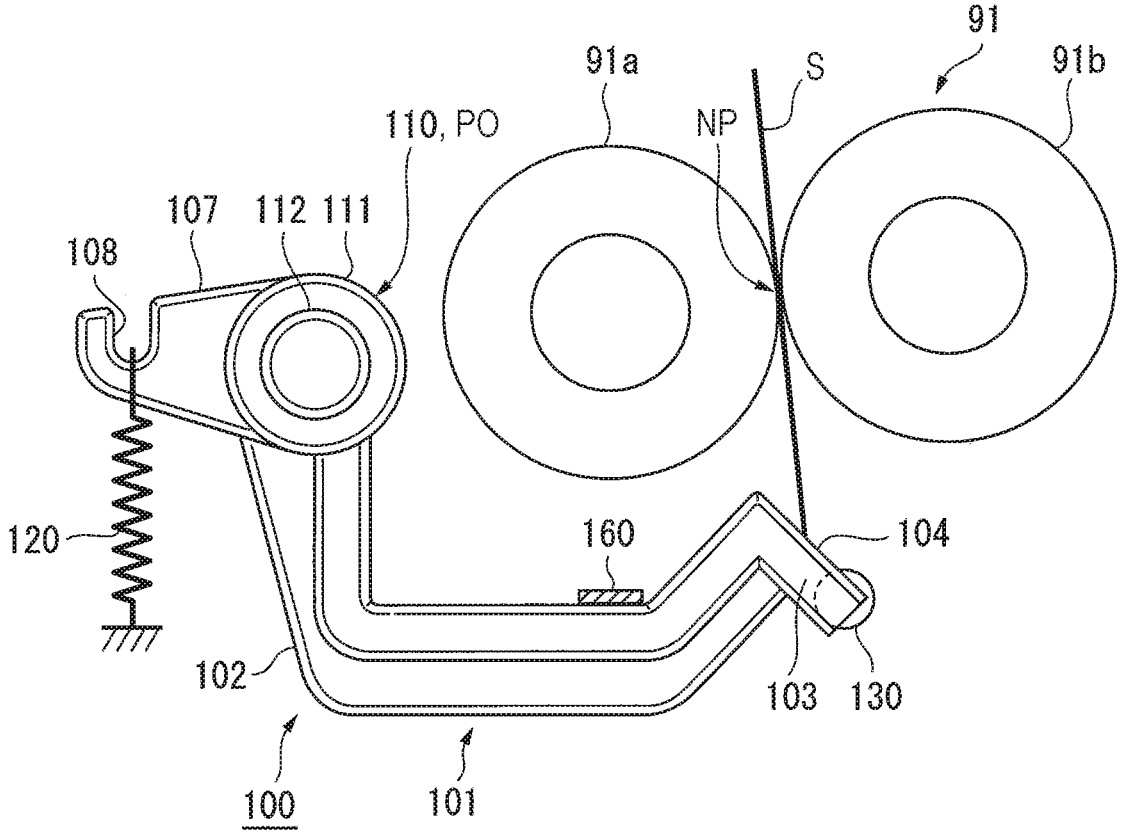
FIG. 10 illustrates relevant elements of a decurling device included in an image forming apparatus according to a second exemplary embodiment.

FIG. 10 illustrates relevant elements of a decurling device 100 included in an image forming apparatus according to a second exemplary embodiment.

The decurling device 100 illustrated in FIG. 10 basically has the same configuration as the decurling device 100 according to the first exemplary embodiment and includes the guide plate 101, the urging spring 120, and the assist roller 130. However, the second exemplary embodiment differs from the first exemplary embodiment in that the assist roller 130 is spaced apart from the transporting roller 91 (specifically the follower roller 91*b*). Note that elements that are the same as those described in the first exemplary embodiment are denoted by corresponding ones of the reference numerals used in the first exemplary embodiment, and detailed description of such elements is omitted.

In the first exemplary embodiment, the initial position of the guide plate 101 is determined by the transporting roller 91 (specifically the follower roller 91*b*) with which the assist roller 130 is in contact. In the second exemplary embodiment, a stopper 160 limits the initial position of the guide plate 101 in replacement of the transporting roller 91.

Hence, in the second exemplary embodiment, if the medium S is a thin medium for example, the thin medium S exited from the nip site NP of the transporting roller 91 comes into contact with the guiding surface 104 of the guide plate 101, moves along the guiding surface 104, advances over the assist roller 130, and is transported toward the downstream side. In this process, since the medium S moves along the guiding surface 104, the medium S is bent in the decurling direction and is thus decurled.

In contrast, if the medium S is a thick medium, the thick medium S exited from the nip site NP of the transporting roller 91 comes into contact with the guiding surface 104 of the guide plate 101, pushes the guide plate 101 in the retracting direction against the urging force exerted by the urging spring 120, advances over the guiding surface 104 and the assist roller 130, and is transported toward the downstream side. In this process, since the medium S advances while causing the assist roller 130 to rotate, the sliding resistance exerted by the medium S on the guiding surface 104 and the assist roller 130 does not become too large. Therefore, the medium S passes the guide plate 101 with good transportability and without being decurled by the guide plate 101.

Third Exemplary Embodiment

Figure 11A:
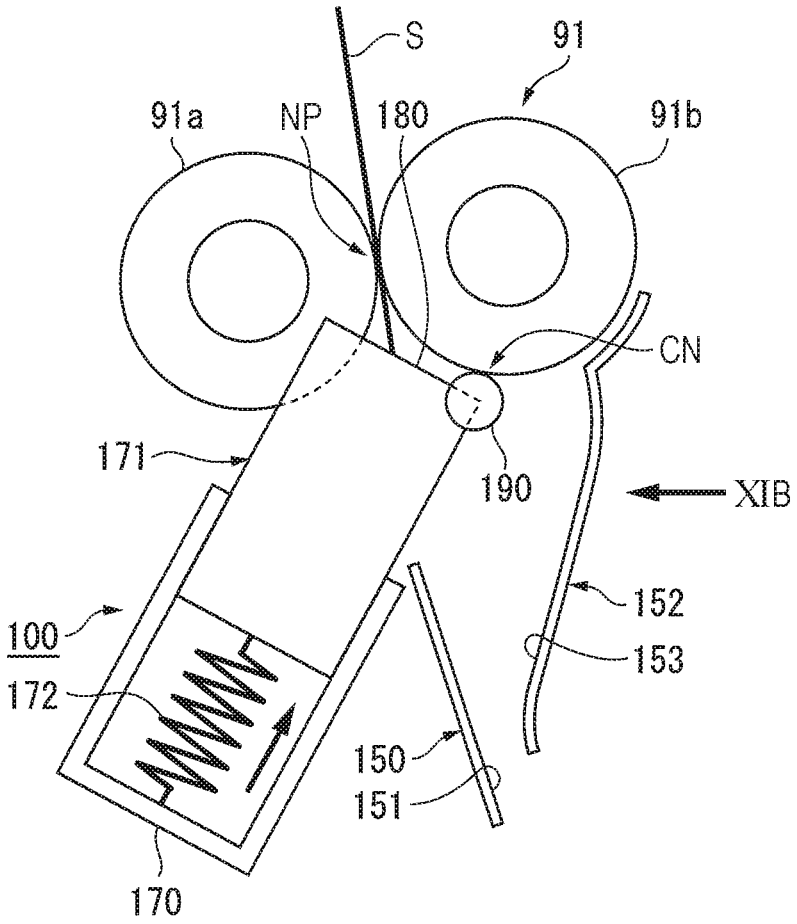
FIG. 11A illustrates relevant elements of a decurling device included in an image forming apparatus according to a third exemplary embodiment.
Figure 11B:
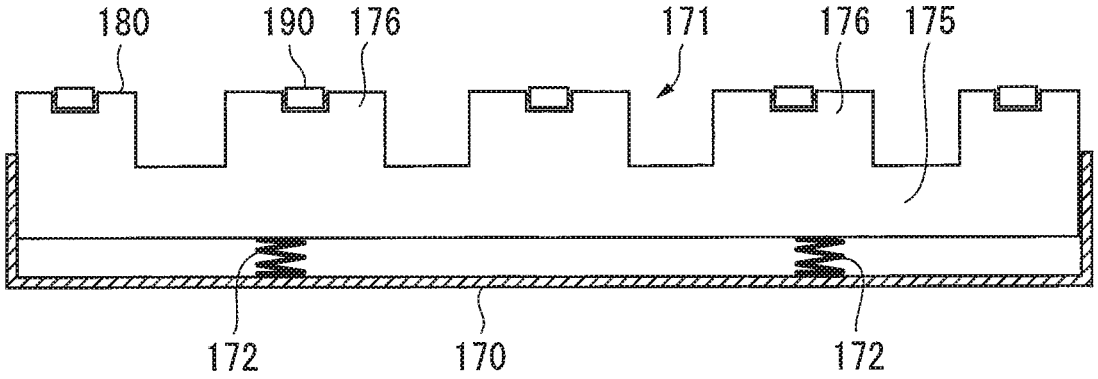
FIG. 11B illustrates the decurling device seen in a direction of arrow XIB illustrated in FIG. 11A.

FIG. 11A illustrates relevant elements of a decurling device included in an image forming apparatus according to a third exemplary embodiment. FIG. 11B illustrates the decurling device seen in a direction of arrow XIB illustrated in FIG. 11A.

The basic configuration of the decurling device 100 illustrated in FIGS. 11A and 11B is different from those of the decurling devices 100 according to the first and second exemplary embodiments that employ a swinging method. The decurling device 100 according to the third exemplary embodiment includes a retaining container 170 having a substantially rectangular-parallelepiped hollow, in which a guide block 171 is positioned while being urged by urging springs 172. The guide block 171 is supported in such a manner as to be linearly movable back and forth within the retaining container 170 against the urging force exerted by the urging springs 172. The guide block 171 includes a substantially rectangular-parallelepiped block body 175 made of synthetic resin such as ABS resin, and separate block members 176 arranged at intervals and projecting from the block body 175 toward the medium transport path. The separate block members 176 are each integrated with the block body 175.

Similarly to the first and second exemplary embodiments, the separate block members 176 according to the third exemplary embodiment are provided at positions corresponding to the respective spaces 913 each provided between adjacent ones of the separate roller members 912 of the driving roller 91*a* included in the transporting roller 91. Thus, the guide block 171 is positioned close to the transporting roller 91 without interfering with the transporting roller 91 (specifically the driving roller 91*a*).

In the third exemplary embodiment, the separate block members 176 forming projections each have, at the head thereof, a guiding surface 180 with which the medium S is bent in the decurling direction. Furthermore, an assist roller 190 is rotatably embedded in a part of the guiding surface 180. In the third exemplary embodiment, the assist roller 190 is positioned in contact with the peripheral surface of the transporting roller 91 (specifically the follower roller 91*b*).

Specifically, the assist roller 190 according to the third exemplary embodiment is provided substantially at the center of an edge of the guiding surface 180 that is on the lower side, i.e. the downstream side in the medium transporting direction. The peripheral surface of the assist roller 190 is positioned slightly above the guiding surface 180 while projecting slightly outward from a side face of the separate block member 176 that adjoins the guiding surface 180.

In the third exemplary embodiment, the contact point between the assist roller 190 and the transporting roller 91 (specifically the follower roller 91*b*) is defined on the downstream side in the medium transporting direction with respect to the contact point between the leading end of the medium S exited from the nip site NP of the transporting roller 91 and the guiding surface 180 of the guide block 171.

Furthermore, the contact point between the assist roller 190 and the transporting roller 91 (specifically the follower roller 91*b*) is displaced from a virtual line along which the transporting roller 91 transports the medium S.

Figure 12B:
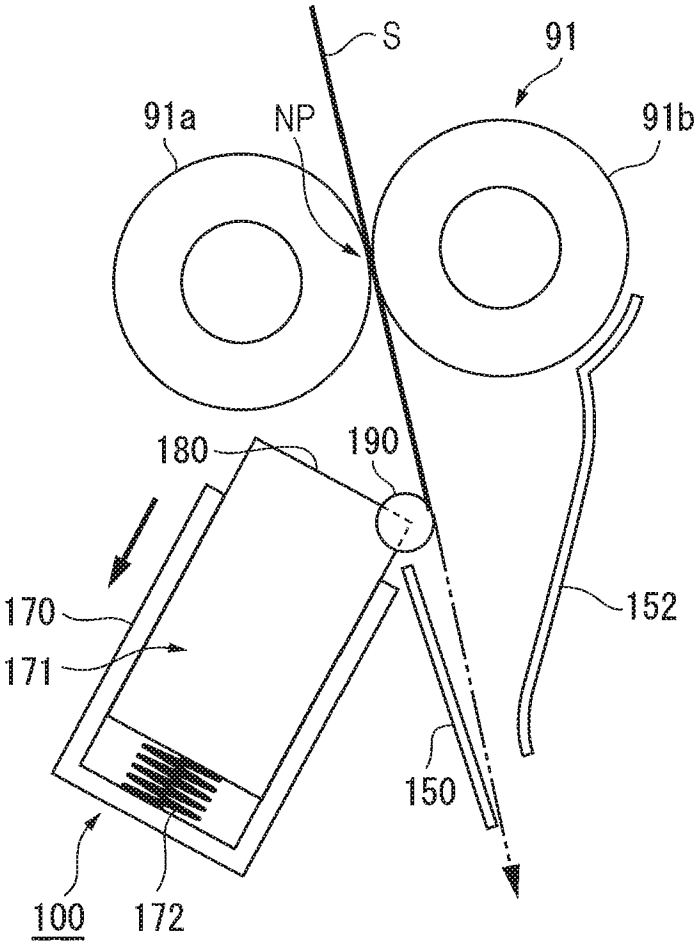
FIG. 12B schematically illustrates how the decurling device behaves in a case of a thick medium.
Figure 12A:
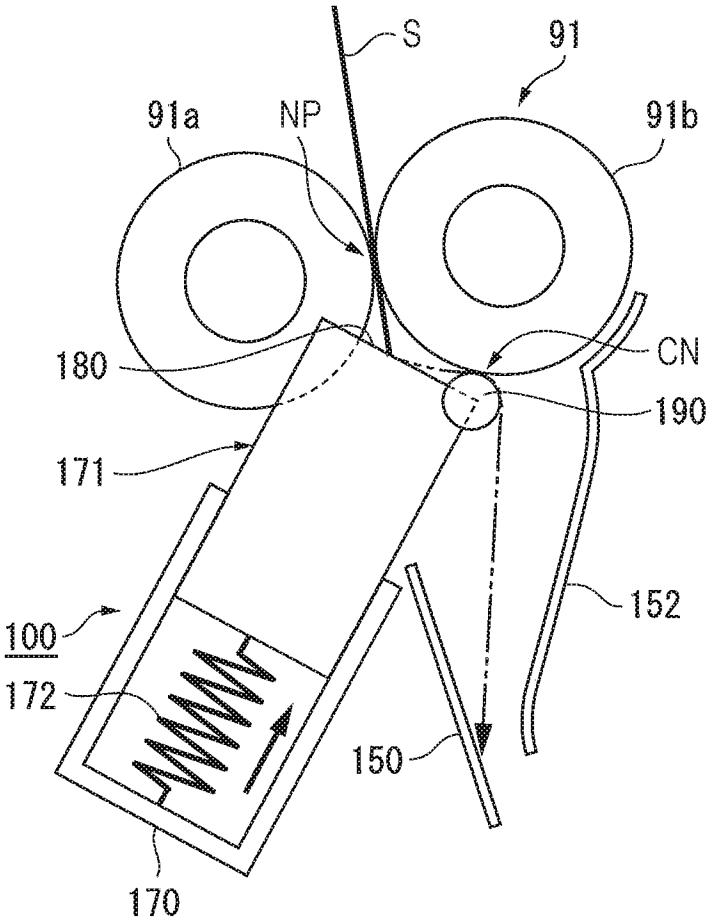
FIG. 12A schematically illustrates a decurling operation performed by the decurling device according to the third exemplary embodiment in a case of a thin medium.

Hence, according to the third exemplary embodiment, as illustrated in FIG. 12A, if the medium S is a thin medium for example, the medium S exited from the nip site NP of the transporting roller 91 comes into contact with the guiding surface 180 of the guide block 171, moves along the guiding surface 180, advances over the contact site CN between the assist roller 190 and the transporting roller 91, and is transported toward the downstream side. In this process, since the medium S advances along the guiding surface 180, the medium S is bent in the decurling direction and is thus decurled.

In contrast, if the medium S is a thick medium, the medium S having passed through the nip site NP of the transporting roller 91 comes into contact with the guiding surface 180 of the guide block 171, pushes the guide block 171 in the retracting direction against the urging force exerted by the urging spring 172, advances over the guiding surface 180 and the assist roller 190, and is transported toward the downstream side. In this process, since the medium S advances while causing the assist roller 190 to rotate, the sliding resistance exerted by the medium S on the guiding surface 180 and the assist roller 190 does not become too large. Therefore, the medium S passes the guide block 171 with good transportability and without being decurled by the guide block 171.

The decurling device 100 according to the third exemplary embodiment employs a method in which the guide block 171 as the guiding member is supported while being urged by the urging springs 172 in such a manner as to be linearly movable back and forth against the urging force exerted by the urging springs 172. In such a method, the movable range of the guiding member is made narrower than in the decurling device 100 according to the first or second exemplary embodiment including the guide plate 101 as a swingable guiding member.

While the above exemplary embodiments each concern a case where the image forming apparatus employs an electrophotographic method, the present disclosure may also be applied to an image forming apparatus employing any other method such as an inkjet method, a relief printing method, a planographic method, an intaglio printing method, or the like. For example, if a recording medium tends to curl with the use of a drying device positioned subsequently to the image forming apparatus, such a curl may be straightened by using the decurling device 100 according to any of the above exemplary embodiments.

The present disclosure may also be applied to an image forming apparatus employing a thermal transfer method implemented with rollers. For example, if a sheet-type medium as an object of transfer tends to curl after an image is thermally transferred thereto, such a curl may be straightened by using the decurling device 100 according to any of the above exemplary embodiments.

The present disclosure may also be applied to an apparatus other than an image forming apparatus, such as a thermocompression bonding apparatus that bonds a sheet-type medium and a film to each other by applying heat and pressure thereto with rollers. In such a case, if the medium tends to curl after the thermocompression process, the decurling device 100 according to any of the above exemplary embodiments may be used.

Note that the drying device, the thermal transfer device, and the thermocompression bonding apparatus are each an example of the heating device according to the present disclosure.

The present disclosure may also be applied to a case of straightening a medium curled by any factor other than heat. For example, the present disclosure may be applied to a case of straightening a sheet-type medium curled by a factor such as an environment (temperature, humidity, and so forth) for storing the sheet-type medium.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A decurling device provided on a downstream side with respect to a fixing device in a medium transporting direction and straightening a curl formed in a medium transported to the decurling device, the decurling device comprising:

a bending unit extending across the medium transporting direction and having a guiding surface that guides a leading end of the medium, the leading end coming into contact with the guiding surface, the bending unit bending the medium in a decurling direction by using the guiding surface;

an urging spring that urges the bending unit toward the medium;

a single or a plurality of rotating members provided on a part of the guiding surface of the bending unit and rotating by coming into contact with the medium that is in contact with the guiding surface, and a transporting unit that is provided between the fixing device and the bending unit and that transports the medium while nipping the medium, wherein the transporting unit includes a plurality transporting rollers, wherein the bending unit is provided on the downstream side with respect to the transporting unit in the medium transporting direction, wherein the rotating member is positioned in contact with the transporting unit, and, wherein if the medium is a thick medium having a thickness greater than or equal to a predetermined threshold, the guiding surface of the bending unit is retracted against the urging force of the urging unit in such a manner as to follow a movement of the medium, and if the medium is a thin medium having a thickness smaller than the predetermined threshold, the guiding surface of the bending unit is retained at a predetermined position.

2. The decurling device according to claim 1, wherein the bending unit is a guiding member movable toward and retractable from a medium transport path along a curved locus and having the guiding surface that guides a leading end of the medium, the leading end coming into contact with the guiding surface.

3. The decurling device according to claim 2, wherein the bending unit is a plate-shaped guiding member positioned in a predetermined orientation with a part of the guiding member serving as a swing fulcrum, the guiding member having the guiding surface that guides a leading end of the medium, the leading end coming into contact with the guiding surface.

4. The decurling device according to claim 1, wherein the bending unit is a guiding member movable toward and retractable from a medium transport path along a linear locus and having the guiding surface that guides a leading end of a medium, the leading end coming into contact with the guiding surface.

5. The decurling device according to claim 1, wherein a contact part of the rotating member that comes into contact with the medium has a flat or curved shape in a widthwise direction intersecting the medium transporting direction.

6. The decurling device according to claim 1, wherein at least a part of the rotating member is shaped with a peripheral surface forming a circular section that is constant in a widthwise direction intersecting the medium transporting direction.

7. The decurling device according to claim 1, wherein a contact point between the rotating member and the transporting unit is defined on the downstream side in the medium transporting direction with respect to a contact point between the leading end of the medium exited from the transporting unit and the guiding surface of the bending unit.

8. The decurling device according to claim 1, wherein a contact point between the rotating member and the transporting unit is displaced from a virtual line along which the transporting unit transports the medium.

9. The decurling device according to claim 7, wherein the contact point between the rotating member and the transporting unit is displaced from a virtual line along which the transporting unit transports the medium.

10. The decurling device according to claim 1, the decurling device further comprising:

a fixed guiding unit that is fixedly provided along the medium transport path and that guides the medium, wherein the bending unit is positioned adjacent to and on an upstream side with respect to the fixed guiding unit in the medium transporting direction, and wherein the fixed guiding unit has a fixed guiding surface provided on a virtual line along which the medium having passed the bending unit advances, the fixed guiding surface guiding the medium coming into contact with the fixed guiding surface.

11. An image forming apparatus comprising:

heater that heats a medium; and the decurling device according to claim 1 that is provided on a downstream side with respect to a fixing device in a medium transporting direction, the decurling device straightening a curl formed near a leading end of a medium transported to the decurling device.

* * * * *